US010232363B2

(12) United States Patent
Goto et al.

(10) Patent No.: US 10,232,363 B2
(45) Date of Patent: Mar. 19, 2019

(54) SAFETY CABINET

(71) Applicants: AIRTECK JAPAN, LTD., Tokyo (JP); JAPAN TISSUE ENGINEERING CO., LTD., Gamagori-shi, Aichi (JP)

(72) Inventors: Hiroshi Goto, Soka (JP); Yosuke Otsuka, Soka (JP); Shinya Hirasawa, Soka (JP); Ken-ichiro Hata, Gamagori (JP); Yukio Mori, Gamagori (JP); Makoto Sugiura, Gamagori (JP)

(73) Assignees: AIRTECK JAPAN, LTD., Tokyo (JP); JAPAN TISSUE ENGINEERING CO., LTD., Gamagori-shi (JP)

( * ) Notice: Subject to any disclaimer, the term of this patent is extended or adjusted under 35 U.S.C. 154(b) by 148 days.

(21) Appl. No.: 15/501,049

(22) PCT Filed: Apr. 7, 2015

(86) PCT No.: PCT/JP2015/060819
§ 371 (c)(1),
(2) Date: Feb. 1, 2017

(87) PCT Pub. No.: WO2016/017211
PCT Pub. Date: Feb. 4, 2016

(65) Prior Publication Data

US 2017/0232434 A1 Aug. 17, 2017

(30) Foreign Application Priority Data

Aug. 1, 2004 (JP) ..... 2014-157485

(51) Int. Cl.

| | |
|---|---|
| ***B08B 15/02*** | (2006.01) |
| ***B01L 1/02*** | (2006.01) |
| ***F24F 7/06*** | (2006.01) |
| ***B01L 1/04*** | (2006.01) |
| ***B25H 1/20*** | (2006.01) |

(52) U.S. Cl.
CPC ..... *B01L 1/025* (2013.01); *B01L 1/04* (2013.01); *B08B 15/023* (2013.01); *B25H 1/20* (2013.01);
(Continued)

(58) Field of Classification Search
None
See application file for complete search history.

(56) References Cited

U.S. PATENT DOCUMENTS

2008/0278040 A1 11/2008 McCarthy et al.
2012/0273047 A1* 11/2012 Yokoi ..... C12M 23/44 137/1

FOREIGN PATENT DOCUMENTS

EP 0139128 A2 5/1985
JP S52-116940 U 9/1977
(Continued)

OTHER PUBLICATIONS

Apr. 3, 2018 Office Action issued in Japanese Patent Application No. 2014-157485.
(Continued)

*Primary Examiner* — Paul S Hyun
(74) *Attorney, Agent, or Firm* — Oliff PLC

(57) ABSTRACT

A safety cabinet has a second operation chamber in a first operation chamber and into which clean air is supplied, a second suction opening for sucking in air in the second operation chamber and a portion of the air in the first operation chamber, and a second operation opening part that is provided facing a first operation opening part and communicates the second operation chamber with the first operation chamber. Airflow containment (air barrier) is doubled with respect to the outside of a safety cabinet. In cases where decontamination and disinfection operations are carried out according to the changeover procedures, inten-
(Continued)

sive decontamination and disinfection of the second operation chamber is sufficient, and decontamination and disinfection of the first operation chamber is hardly required. Decontamination and disinfection operations in the changeover procedures and the like can be carried out in a greatly reduced time.

6 Claims, 5 Drawing Sheets

(52) U.S. Cl.
CPC ..... *F24F 7/06* (2013.01); *B01L 2300/0681* (2013.01); *B01L 2300/10* (2013.01)

(56) References Cited

FOREIGN PATENT DOCUMENTS

| | | | |
|---|---|---|---|
| JP | S60-048268 | A | 3/1985 |
| JP | S60-165180 | U | 11/1985 |
| JP | S61-145236 | U | 9/1986 |
| JP | H01-288342 | A | 11/1989 |
| JP | H02-277556 | A | 11/1990 |
| JP | H03-12238 | A | 1/1991 |
| JP | H05-76781 | A | 3/1993 |
| JP | 3533649 | B2 | 5/2004 |
| JP | 2005-66537 | A | 3/2005 |
| JP | 2005-334771 | A | 12/2005 |

OTHER PUBLICATIONS

Jan. 29, 2018 Extended Search Report issued in European Patent Application No. 15826464.8.
Jul. 7, 2015 Search Report issued in International Patent Application No. PCT/JP2015/060819.
Jun. 7, 2015 Written Opinion issued in International Patent Application No. PCT/JP2015/060819.

* cited by examiner

SAFETY CABINET

TECHNICAL FIELD

The present invention relates to a safety cabinet used in industrial fields, such as medical care, regenerative medicine, and pharmaceutical.

BACKGROUND ART

Safety cabinets have an operation chamber which is in a semi-sealed state except for its operation opening, and are configured to suck in contaminated aerosols which are generated in the operation chamber, and prevent the aerosols from flowing into an operator's side. They are also provided with a function of sterilizing and cleaning, by a HEPA filter, contaminated air which has been sucked in and collected, and then discharging the sterilized and cleaned air. They are classified into classes I, II, and III according to a level of pathogenic organs to be treated.

An example of such safety cabinets is known, as described in Patent Literature 1. With such conventional safety cabinets, for example, as shown in FIG. 4 and FIG. 5, an operation chamber 2 is provided above a workbench 1, and has an operation opening 3 in its front lower part, and the operation opening 3 is openable and closable by a shutter 4.

A slit-shaped inlet port 5 is provided along the front edge and the rear edge of the workbench 1. Air sucked in through the inlet port 5 circulates an air passage 7 due to the operation of a fan 6. A portion of the air is cleaned by an air cleaning units 8, such as a HEPA filter, and is again supplied into the operation chamber 2. The remaining portion of the air is cleaned by an air cleaning units 9, such as a HEPA filter, and is discharged outside through an exhaust port 17. In FIG. 4, the arrow shows the flow of air (airflow).

With such safety cabinet K, through a balance between an inflow airflow supplied into the operation chamber 2, a circulating airflow which is sucked in through the inlet port 5 provided at the front edge and the rear edge of the operation chamber 2, and circulates the air passage 7, and an airflow discharged outside, an air barrier B is formed at the operation opening 3, and the sterile environment and containment of the air in the operation chamber 2 is maintained.

While cell processing organisms, such as skin, cartilage, and a cornea, used for regenerative medicine are transplanted to a patient, in order to prevent exogenous microbial contamination, it is necessary to carry out this cell processing by an aseptic manipulation in an important zone, that is, a space which has a cleanliness of grade A.

On the other hand, since cell processing organisms from autogenous cells to be treated (hereinafter referred to as cells) are not necessarily sterile, an important zone, for example, the operation chamber 2 of the safety cabinet K may be contaminated due to aerosols which are generated by a processing operation. Because of this, in cases where the cell processing operation is carried out in the same equipment (safety cabinet K), decontamination and disinfection operations are carried out according to changeover procedures defined beforehand, and thus cross contamination is prevented.

The changeover means that after a processing process using cell tissue of a patient is completed, another process using cell tissue of another patient employed.

The changeover procedures are steps of decontaminating and disinfecting the surface to which aerosols and droplets may have adhered at the time of the cell processing operation for a patient. Environment of a workbench and the like in a room or in a safety cabinet, apparatuses such as a cultivation container and a pipette which directly contact cells, an operator's glove and the like, are decontaminated and disinfected according to a series of steps.

In an exchange operation of culture solution for which a conventional safety cabinet K is used, as shown in FIG. 5, in order to prevent cross contamination, a cultivation-container-storage-case 10 is opened outside of the safety cabinet K, a cultivation container 11 is taken out of the cultivation-container-storage-case 10, and the lid of the cultivation container 11 is opened in the operation chamber 2 of the safety cabinet K, and the culture solution is exchanged.

After the exchange operation of culture solution, in order to operate another patient's cell, it is necessary to decontaminate and disinfect the whole workbench 1 of the safety cabinet K according to the changeover procedures, and to prevent the cross contamination between the cells.

CITATION LIST

Patent Literature

Patent Literature 1: JP 3533649

SUMMARY OF INVENTION

Technical Problem

However, in cases where the conventional safety cabinet K is used, it takes 30 to 120 minutes at present to carry out decontamination and disinfection operations according to the changeover procedures.

Since the cell processing is characterized in that many patients are involved and the processing is handled with a small lot (cells), it is necessary to carry out the changeover procedures frequently, and thus there is a problem in that the changeover procedures take a lot of time relative to a time of carrying out cell processing itself.

The present invention has been made in view of the above situation, and an object thereof is to provide a safety cabinet which allows decontamination and disinfection operations in the changeover procedures and the like to be carried out in a greatly reduced time.

Solution to Problem

To achieve the above object, a safety cabinet according to the present invention includes:

a workbench;

a first operation chamber which is disposed above the workbench, and into which clean air is supplied;

a first operation opening communicating the first operation chamber with the outside;

a first inlet port which is disposed at a bottom of the first operation chamber, and which sucks in the clean air supplied into the first operation chamber and air flowing in from the outside through the first operation opening;

a second operation chamber which is disposed in the first operation chamber, and into which clean air is supplied;

a second inlet port which is disposed at a bottom of the second operation chamber, and which sucks in air in the second operation chamber and a portion of air in the first operation chamber; and a second operation opening facing the first operation opening, the second operation opening communicating the second operation chamber with the first operation chamber.

In the present invention, as long as the front side of the second operation opening faces the first operation opening, the both sides and the rear of the second operation chamber may be opened or blocked with walls. However, it is advantageous in operability of cell processing that the second operation chamber is opened.

In the present invention, the cultivation container in which cells are contained is taken into the second operation chamber through the first operation opening and the second operation opening from the outside, the cultivation container is opened in the second operation chamber, and the cultivation co container is closed after processing. Namely, a series of such processing operations are carried out in the second operation chamber.

Clean air is supplied into this second operation chamber, and the air in this second operation chamber and a portion of clean air which are supplied into the first operation chamber are sucked in through the second inlet port. Thus, an air barrier is formed at the second operation chamber due to air sucked into the second inlet port. This air barrier can prevent aerosols and/or droplets which may be generated during cell processing from leaking into the first operation chamber.

Clean air is supplied into the first operation chamber, and air in this first operation chamber and air which flows in from the outside through the first operation opening are sucked in through the first inlet port. Thus, another air barrier is formed at the first operation chamber due to the air sucked into the first inlet port.

Thus, both of the first operation chamber and the second operation chamber have respective air barriers. Namely, airflow containment (air barrier) is doubled with respect to the outside of the safety cabinet. This configuration allows the safety cabinet to have two zones of the first operation chamber and the second operation chamber, and can achieve the strengthened isolation by airflow control.

Thus, in cases where decontamination and disinfection operations are carried out according to the changeover procedures, intensive decontamination and disinfection of the second operation chamber is sufficient, and decontamination and disinfection of the first operation chamber is hardly required.

Therefore, decontamination and disinfection operations in the changeover procedures and the like can be carried out in a greatly reduced time. For example, although conventional changeover procedures take 30 to 120 minutes, the changeover procedures according to the present invention can be shortened within five minutes.

In the configuration of the present invention, preferably, a working table is placed on a bottom face of the second operation chamber.

According to this configuration, in a state where the cultivation container which is carried into the second operation chamber through the first operation opening and the second operation opening from the outside is placed on the working table, the cultivation container is opened, and is closed after processing. Since this cultivation container contacts the working table alone, decontamination and disinfection of the second operation chamber can be almost omitted in the changeover procedures, by exchanging this working table for a new working table which is decontaminated and disinfected beforehand. This allows decontamination and disinfection operations in the changeover procedures and the like to be further shortened since only a glove need to be exchanged.

In the configuration of the present invention, preferably, the bottom face of the second operation chamber is located below the bottom face of the first operation chamber, and the second inlet port is disposed between the two bottom faces.

According to this configuration, since the second inlet port is provided between the bottom face of the first operation chamber, and the bottom face of the second operation chamber, an air barrier is formed at the second operation chamber to reach a position lower than the bottom face of the first operation chamber due to air sucked into the second inlet port. Thus, when a cell processing operation is carried out using the cultivation container in the second operation chamber, this air barrier can surely prevent aerosols and/or droplets which may be generated during cell processing from leaking into the first operation chamber.

In the configuration of the present invention, preferably, a circulation flow passage is provided which circulates, through the first operation chamber and the second operation chamber, air sucked in through the first inlet port and the second inlet port, and the circulation flow passage is provided with air cleaning means.

According to this configuration, since the air cleaning means is provided the circulation flow passage, aerosols and/or droplets which may be generated during cell processing in the second operation chamber are removed and cleaned by the air cleaning means, and air in the first operation chamber and air which flows in from the outside through the first operation opening is cleaned by the air cleaning means, and the air can be again supplied through the circulation flow passage into the first operation chamber and the second operation chamber. Accordingly, the first operation chamber and the second operation chamber can always serve as a space which has a cleanliness of grade A.

In the configuration of the present invention, preferably, the air cleaning means includes a first air cleaning unit disposed upstream of the first operation chamber, and a second air cleaning unit disposed downstream of the second operation chamber and upstream of the first air cleaning unit.

According to this configuration, after air which flows into the circulation flow passage through the first inlet port of the first operation chamber and the second inlet port of the second operation chamber is cleaned by the second air cleaning unit, a portion of the air can be supplied into the second operation chamber, and after the remaining portion of the air is further cleaned by the first air cleaning unit, the remaining portion of the air can be supplied into the first operation chamber. Accordingly, the first operation chamber can always serve as a space which has a cleanliness of grade A.

Advantageous Effects of Invention

In the present invention, both of the first operation chamber and the second operation chamber have the respective air barriers. Namely, airflow containment (air barrier) is doubled with respect to the outside of the safety cabinet. This configuration allows the safety cabinet to have two zones of the first operation chamber and the second operation chamber, and can achieve the strengthened isolation by airflow control.

Thus in cases where decontamination and disinfection operations are carried out according to the changeover procedures, intensive decontamination and disinfection of the second operation chamber is sufficient, and decontamination and disinfection of the first operation chamber is hardly required. Therefore, decontamination and disinfection operations in the changeover procedures and the like can be carried out in a greatly reduced time.

DESCRIPTION OF EMBODIMENTS

Hereinafter, an embodiment of the invention is described with reference to drawings.

Figure 1:
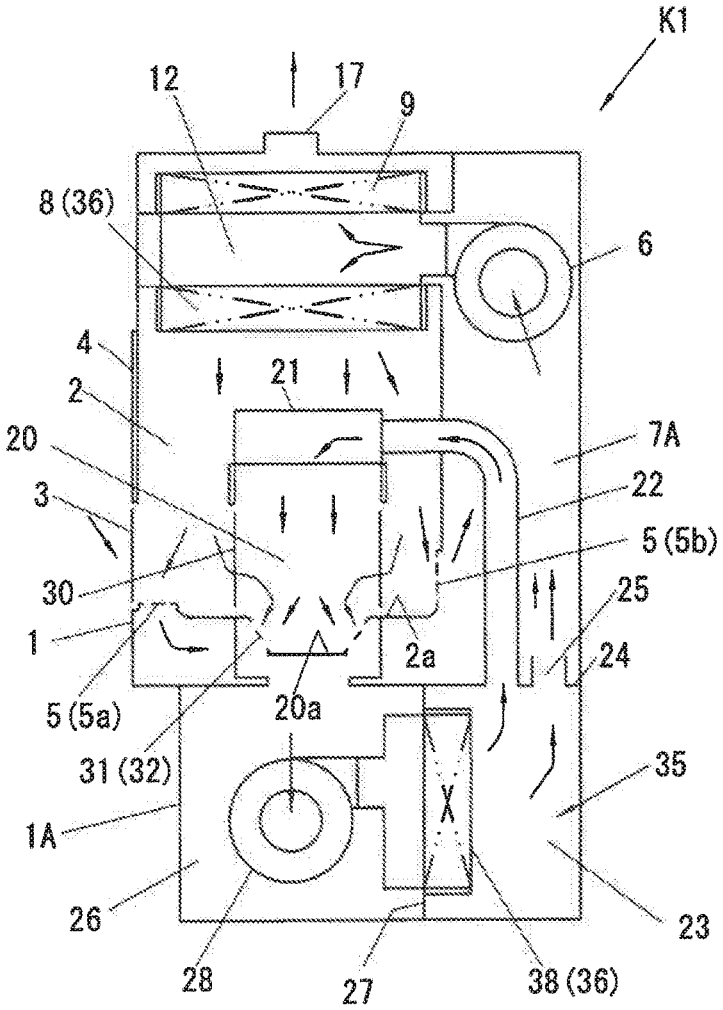
FIG. 1 shows an example of a safety cabinet of an embodiment of the invention, and is a sectional view of the safety cabinet.
Figure 2:
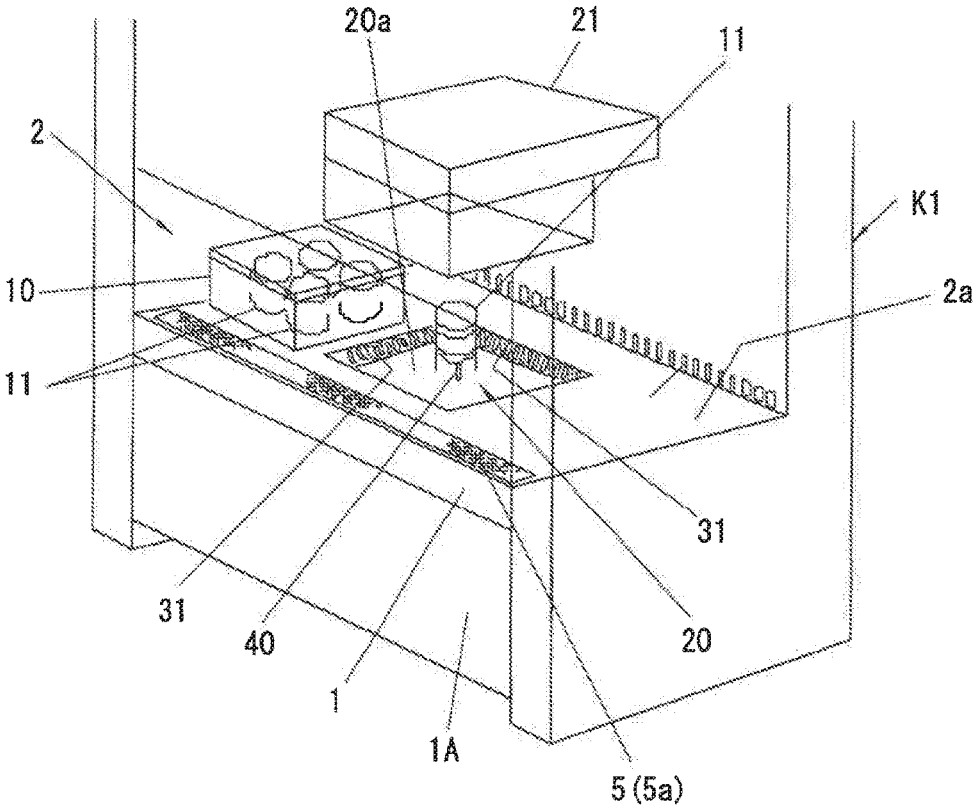
FIG. 2 is a schematic perspective view of the principal part of the safety cabinet.

FIG. 1 and FIG. 2 are sectional views of the schematic structure of a safety cabinet K1 according to an embodiment. FIG. 2 is a schematic perspective view of the principal part of the safety cabinet K1. In FIG. 1, the arrow shows a flow (airflow) of air.

As with a conventional safety cabinet 1, a safety cabinet K1 includes a workbench 1, a first operation chamber 2, a first operation opening 3, a shutter 4, a first inlet port 5, a fan 6, air cleaning units 8 and 9, and the like. A lower box 1A for housing a fan 28 and chambers 23 and 26, which are mentioned below, is provided in the lower part of the workbench 1.

The first operation chamber 2 is provided above the workbench 1. The shutter 4 made of tempered glass is formed at the front of the first operation chamber 2.

Sliding up and down of this shutter 4 allows the front opening of the first operation chamber 2 to open and close. The first operation opening 3 is formed under the shutter 4 by sliding the shutter 4 upward from a closed state, and holding it in a predetermined position.

The inlet port 5 (5*a*, 5*b*) is provided at the front edge and the rear edge of the workbench 1 respectively. The inlet port 5*a* at the front edge is provided with an air suction plate having many holes at an oblong opening disposed along the front edge of the workbench 1. The inlet port 5*b* at the rear edge is configured to form many longwise slits with prescribed intervals in the longitudinal direction of the rear edge of the workbench 1.

The fan 6 is provided in the upper part of the safety cabinet K1, and in the upper part of an air passage 7A. Air (airflow) which flows through the air passage 7A is blown out into the air cleaning units 8 and 9. The air passage 7A is configured to extend in the upper and lower direction at the rear side of the first operation chamber 2.

The air cleaning units 8 and 9 each include a HEPA filter, and air from the fan 6 is blown out into a space 12 between the air cleaning units 8 and 9. A portion of the air which is blown out from the fan 6 is cleaned by the first air cleaning unit 8, and is again supplied into the first operation chamber 2, and the remaining portion of the air is cleaned by the air cleaning unit 9 and discharged outside through an exhaust port 17.

A second operation chamber 20 is provided approximately at the center of the first operation chamber 2. This second operation chamber 20 is a space defined by four pillars, which are not illustrated, wherein, for example, the four pillars are disposed at respective four corners with respect to a plane view of the second operation chamber 20.

An air outlet 21 is provided in the upper part of the second operation chamber 20. This air outlet 21 is supported by the top ends of the four pillars. A second air passage 22 is connected to the rear of the air outlet 21. This second air passage 22 includes, for example, a cylindrical pipe, and has one end (bottom end) communicating with a chamber 23 provided in the lower part of the air passage 7A, and the other end which connected to the air outlet 21.

A partition 24 is arranged approximately horizontally in the lower part of the air passage 7A, and the other end of the second air passage 22 is connected to this partition 24, and the lower part of the air passage 7A has an opening to the chamber 23 which is disposed below the partition 24. A hole 25 is provided in the partition 24. This hole 25 allows the air passage 7A and the chamber 23 to communicate with each other.

The chamber 26 is provided below the first operation chamber 2 and the second operation chamber 20. The chamber 23 is disposed adjacent to the chamber 26 through a partition 27. The fan 28 is disposed on the partition 27. This fan 28 allows air in the chamber 26 to be blown out into the chamber 23. The fan 28 and the chambers 23 and 26 are disposed in the lower box 1A.

The front/rear and right/left faces of the second operation chamber 20 are opened, and the front face serves as a second operation opening 30. This second operation opening 30 communicates the second operation chamber 20 with the first operation chamber 2, and a cultivation container and the like can be carried into the second operation chamber 20 from the outside, and an operation of cell processing and the like is enabled.

A second inlet port 31 which sucks in clean air which is blown out through the air outlet 21 and is supplied into the second operation chamber 20, and a portion of clean air which is supplied into a first operation space 2 is disposed at the bottom of the second operation chamber 20. This second inlet port 31 is configured to surround the bottom of the second operation chamber 20 along the periphery of its bottom. Specifically, a bottom face 20*a* of the second operation chamber 20 is located below a bottom face 2*a* of the first operation chamber 2, and the second inlet port 31 is configured such that an air suction plate 32 having many slits is disposed at an opening between the bottom faces 20*a* and 2*a*. The air suction plate 32 is arranged so that it inclines inwardly from the bottom face 2*a* of the first operation chamber 2 to the bottom face 20*a* of the second operation chamber 20.

A space below the second inlet port 31 communicates with a space below the bottom face 20*a* of the second operation chamber 20, which communicates with the chamber 26. Since the chamber 26 has a negative pressure due to the operation of the fan 28, air is sucked into the chamber 26 through the second inlet port 31, and further blown out into the chamber 23 due to the operation of the fan 28.

A space below the first inlet port 5 does not communicate with the chamber 26, but communicate with the air passage 7A. Thus, air sucked in through the first inlet port 5 flows into the air passage 7A.

The chambers 26 and 23, the air passage 7A, the space 12, and the second air passage 22 constitute a circulation flow passage 35 which circulates air sucked in through the first inlet port 5 and the second inlet port 31 into the first operation chamber 2 and the second operation chamber 20, and air cleaning means 36 is provided in this circulation flow passage 35.

Specifically, the air cleaning means 36 is constituted by the first air cleaning unit 8 and the second air cleaning unit 38. The first air cleaning unit 8 is provided upstream of the first operation chamber 2. Namely, the first air cleaning unit 8 faces the space 12, and is provided on the ceiling of the first operation chamber 2.

The second air cleaning unit 38 includes the HEPA filter as with the first air cleaning unit 8 and is disposed downstream of the second operation chamber 20, and upstream of the first air cleaning unit 8. Specifically, the second air cleaning unit 38 is attached to the partition 27 between the chambers 26 and 23 such that the second air cleaning unit 38 is disposed on the chamber 23 side and is configured to cover the outlet of the fan 28.

Figure 3:
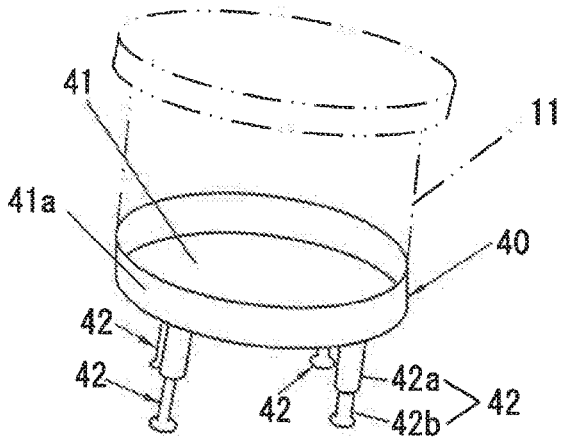
FIG. 3 is a perspective view of a working table.
Figure 4:
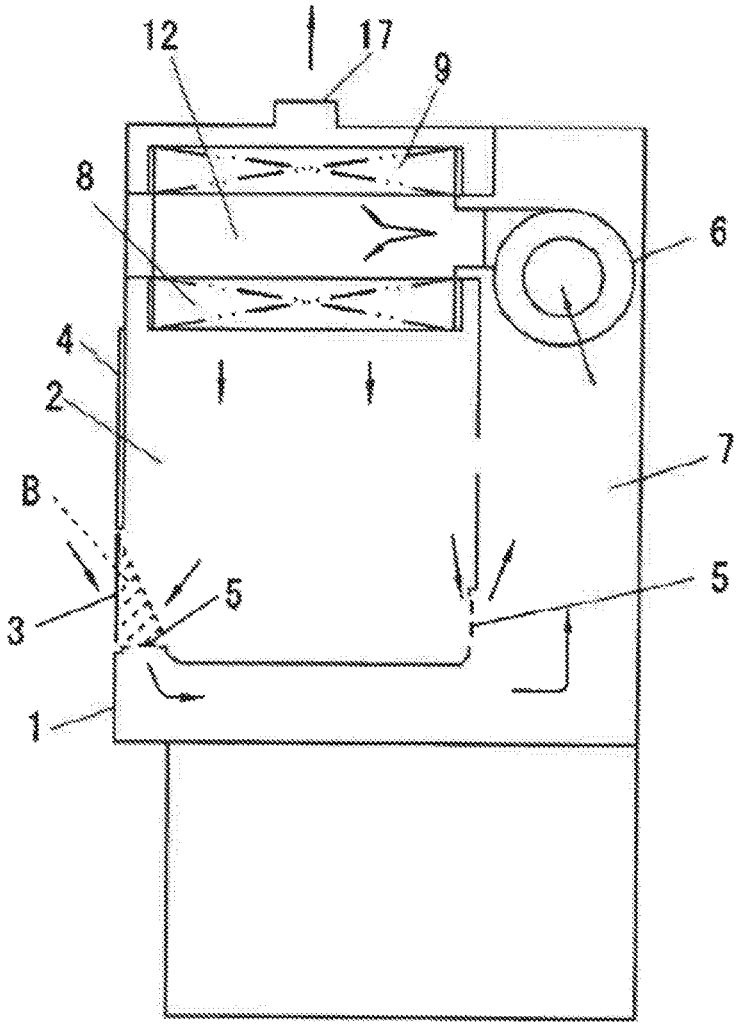
Fig. 4 [Related Art]
FIG. 4 is an example of a conventional safety cabinet, and is its sectional view.
Figure 5:
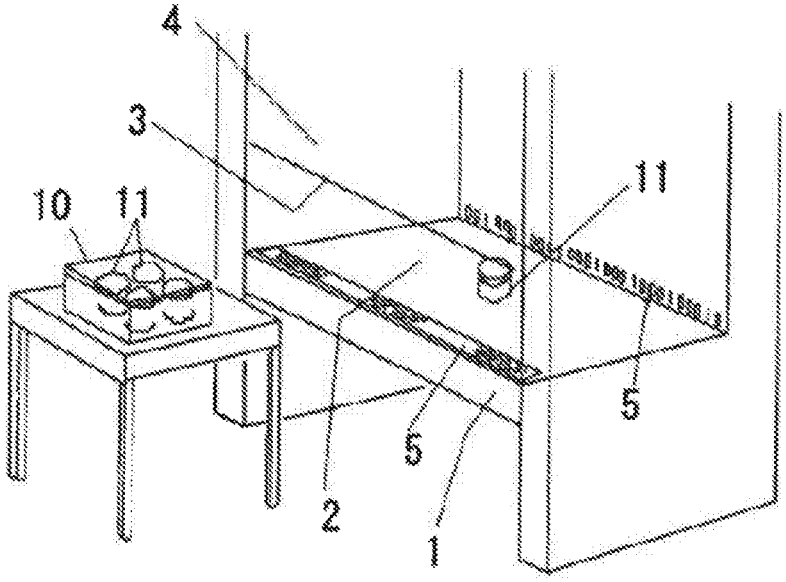
Fig. 5 [Related Art]
FIG. 5 is a schematic perspective view of the principal part of the conventional safety cabinet.

As shown in FIG. 2, a working table 40 is placed on the bottom face 20*a* of the second operation chamber 20. As shown in FIG. 3, this working table 40 includes a disc-like table body 41 and four legs 42, which are disposed on the undersurface of the table body 41 and support the table body 41.

The table body 41 has an annular peripheral wall part 41*a* on its peripheral part, and a cultivation container 11 is placed on the working table 40 such that the cultivation container 11 is inserted inside this peripheral wall part 41*a*. The peripheral wall part 41*a* is configured to be lower than the cultivation container 11.

Each leg 42 includes a cylinder part 42*a* inside which a female thread is formed, and a male threaded part 42*b* which is screwed into the lower end opening of the cylinder part 42*a*, and each leg is configured such that the length of the male threaded part 42*b* extending from the lower end of the cylinder part 42*a* can adjusted by the rotation of the male threaded part 42*b*.

The legs 42 of the working table 40 with this configuration are placed on the bottom face 20*a* of the second operation chamber 20. Thus, only the lower ends of the male threaded parts 42*b* of the legs 42 contact the bottom face 20*a*.

When the working table 40 is placed on the bottom face 20*a* of the second operation chamber 20, the working table 40 is configured to be able to incline relative to the horizontal plane by shortening the extension length of two male threaded parts 42*b* beforehand.

The safety cabinet K1 of the above embodiments is installed and used in a space which has a cleanliness of grade B. The inside of safety cabinet K1, namely, the insides of the first operation chamber 2 and the second operation chamber 20 serve as a space which has a cleanliness of grade A.

In cases where an exchange operation of culture solution is conducted in this safety cabinet K1, the fans 6 and 28 are started first before the cultivation container 11 is carried into the second operation chamber 20.

Airflow arises in the safety cabinet K1 due to the operation of the fans 6 and 28. Since the air passage 7A has a negative pressure in a space below the first inlet port 5 (5*a*, 5*b*) due to the operation of the fan 6, air is sucked in through the first inlet port 5 (5*a*, 5*b*) of the first operation chamber 2, and flows into the air passage 7A. Air sucked into the first inlet port 5*a* includes air which flows through the first operation opening 3 from the outside, and clean air which is blown out downward from the ceiling of the first operation chamber 2 due to the operation of the fan 6. Accordingly, since an air barrier formed at the first operation opening 3 due to this air, foreign substances, such as bacteria and microorganisms, do not enter the first operation chamber 2 from the outside, and similar foreign substances is not carried away from the first operation space 2 into the outside. Air sucked in through the first inlet port 5*b* is clean air which is blown out downward from the ceiling of the first operation chamber 2.

Air which flows into the air passage 7A is blown out into the space 12 due to the operation of the fan 6. A portion of the clean air blown out into this space 12 is cleaned by the first air cleaning unit 8, and is blown out downward from the ceiling of the first operation chamber 2.

Since the chamber 26 has a negative pressure due to the operation of the fan 28, air is sucked into the chamber 26 through the second inlet port 31 of the second operation chamber 20.

While the air sucked into chamber 26 is blown out into the chamber 23 due to the operation of the fan 28, foreign substances are removed by the second air cleaning unit 38, and the air is cleaned. A portion of this cleaned air passes through the second air passage 22, and is blown out downward through the air outlet 21 at the ceiling of the second operation chamber 20. Since the second operation chamber 20 is filled with the cleaned air (clean air), it serves as a space which has a cleanliness of grade A.

On the other hand, the remaining portion of the cleaned air passes through the air passage 7A from the hole 25, and is blown out into the space 12 due to the operation of the fan 6. A portion of the clean air which is blown out into this space 12 is further cleaned by the first air cleaning unit 8, and is blown out downward from the ceiling of the first operation chamber 2. Thus, since the first operation chamber 2 is filled with the further cleaned air, serves as a space which has a cleanliness of grade A.

A portion of the clean air of the first operation chamber 2 and the clean air of the second operation chamber 20 are sucked into the chamber 26 through the second inlet port 31. Since another air barrier is formed at the second operation opening 30 due to this air, foreign substances, such as bacteria and microorganisms, do not enter the second operation chamber 20 from the outside, and similar foreign substances are not carried away from the second operation chamber 20 into the first operation chamber 2 and the outside.

Thus, in a state where each air barrier is formed at the first operation opening 3 of the first operation chamber 2, and the second operation opening 30 of the second operation chamber 20, namely, in a state where the double air barriers are formed, the cultivation container 11 is carried into the second operation chamber 20 from the outside through the first operation opening 3 and the second operation opening 30. The double air barriers are formed with a balance between air which flows through the first operation opening 3 from the outside, air sucked in through the first inlet port 5 and the second inlet port 31, air which flows through the circulation flow passage 35, air which is blown out into the first operation chamber 2 and the second operation chamber 20, and air discharged outside through the exhaust port 17. The balance allows the first operation chamber 2 and the second operation chamber 20 to be maintained under the sterile environment.

Since the legs 42 of the working table 40 are placed on the bottom face 20*a* of the second operation chamber 20 beforehand, the cultivation container 11 is placed on the working table 40 such that the cultivation container 11 inserted inside the peripheral wall part 41*a* of the working table 40.

Then, the lid of the cultivation container 11 is opened in the second operation chamber 20, and the exchange operation of culture solution is carried out. The exchange operation of culture solution is carried out using a pipette and the like. Since the working table 40 inclines relative to its horizontal surface, the culture solution to be exchanged collects in a lower portion of the cultivation container 11. Thus, this culture solution can be easily sucked out with the pipette and the like. After a new culture solution is supplied into the cultivation container 11 with a pipette, the cultivation container 11 is closed with the lid. The cultivation container 11 is taken outside of the safety cabinet K1 through the second operation opening 30 and the first operation opening 3. The working table 40 is exchanged for every cell to handle, and is put in a predetermined container, and decontamination and disinfection operations are carried out collectively.

In cases where the cultivation container 11 is taken in and out of the second operation chamber 20, the cultivation container 11 may be held by an operator's hands, a robot arm, etc., and the cultivation container 11 may be taken in and out without the installation of the working table 40 on the bottom face 20*a* of the second operation chamber 20. Further, the exchange operation of culture solution or other operations may be carried out without placing the cultivation container 11 on the bottom face 20*a* of the second operation chamber 20. In the case of a manual operation by an operator, preferably, the operator carries out an exchange operation wearing a disposable glove. In the case of the exchange operation by a robot arm, preferably, a disposable covering is provided at a position where the robot arm contacts the cultivation container 11, or a proper and short time decontamination of the robot arm is carried out.

After the exchange operation of culture solution in the second operation chamber 20 is carried out, preferably, safety cabinet K1 is configured such that culture solution and a used chip, which has been attached to the tip of a pipette, are collected or discarded in the second operation chamber 20. In this case, for example, a collection case with a lid may be provided on the bottom face 20*a* of the second operation chamber 20, or the bottom face 20*a* may include an opening for disposal such that the used chip may be discarded in a disposal box separately provided through this opening.

According to this embodiment as mentioned above, the cultivation container 11 in which cells are contained is taken into the second operation chamber 20 through the first operation opening 3 and the second operation opening 30 from the outside, and the lid of the cultivation container 11 is removed and opened in this second operation chamber 20, and the container is closed after processing. Namely, such a series of processing operations are carried out in the second operation chamber 20.

Clean air is supplied into this second operation chamber 20 through the air outlet 21 in its ceiling, and this clean air is sucked in through the second inlet port 31, and a portion of the clean air supplied into the first operation chamber 2 is also sucked in through the second inlet port 31. The air thus sucked into the second inlet port 31 forms the air barrier in the second operation chamber 20. This air barrier can prevent aerosols and/or droplets which may be generated during cell processing, such as the exchange operation of culture solution, from leaking into the first operation chamber 2.

In addition, clean air is supplied from above into the first operation chamber 2, and this clean air is sucked in through the first inlet port 5*a*, and air which flows in from the outside is also sucked in through the first inlet port 5*a*. Thus, the air barrier is formed at the first operation chamber 2 due to the air sucked into the first inlet port 5*a*.

Thus, both of the first operation chamber 2 and the second operation chamber 20 have the respective air barriers. Namely, airflow containment (air barrier) is doubled with respect to the outside of the safety cabinet K1. This configuration allows the safety cabinet K1 to have two zones of the first operation chamber 2 and the second operation chamber 20, and can achieve the strengthened isolation by airflow control.

Thus, in cases where decontamination and disinfection operations are carried out according to the changeover procedures, intensive decontamination and disinfection of the second operation chamber 20 is sufficient, and decontamination and disinfection of the first operation chamber 2 is hardly required.

Therefore, the changeover procedures can be carried out in a greatly reduced time as compared with changeover procedures employed by conventional safety cabinets. For example, although conventional changeover procedures take 30 to 120 minutes, the changeover procedures according to the present invention can be shortened within five minutes.

In addition, since the safety cabinet K1 can have two zones of the first operation chamber 2 and the second operation chamber 20, as shown in FIG. 2, the cultivation-container-storage-case 10 which stores the cultivation container 11 can be carried into the first operation chamber 2, and opened in the first operation chamber 2. Accordingly, a next cultivation container 11 can be easily carried into the second operation chamber 20 from the first operation chamber 2.

In addition, since the working table 40 is placed on the bottom face 20*a* of the second operation chamber 20, the cultivation container 11 is opened and is closed after processing in a state where the cultivation container 11 carried into the second operation chamber 20 is placed on the working table 40. Since this cultivation container 11 contacts the working table 40 alone, decontamination and disinfection of the second operation chamber 20 are almost omitted in the changeover procedures, by exchanging this working table 40 for a new working table 40 which is decontaminated and disinfected beforehand. This allows the changeover procedures to be further shortened.

Since the second inlet port 31 is provided between the bottom face 2*a* of the first operation chamber 2, and the bottom face 20*a* of the second operation chamber 20, the air barrier is formed at the second operation chamber 20 to reach a position lower than the bottom face 2*a* of the first operation chamber 2 due to air sucked into the second inlet port 31. Thus, when a cell processing operation is carried out using the cultivation container 11 in the second operation chamber 20, this air barrier can surely prevent aerosols and/or droplets which may be generated during cell processing from leaking into the first operation chamber 2.

Further, the circulation flow passage 35 which circulates air sucked in through the first inlet port 5 and the second inlet port 31 through the first operation chamber 2 and the second operation chamber 20 is provided, and the air cleaning means 36 (first air cleaning unit 8 and second air cleaning unit 38) is provided in this circulation flow passage 35. Thus, aerosols and/or droplets which may be generated during cell processing are removed and cleaned by the air leaning means 36 in the second operation chamber 20, and air in the first operation chamber 2 is cleaned by the air cleaning means 36, and can be again supplied through the circulation flow passage 35 into the first operation chamber 2 and the second operation chamber 20. Accordingly, the first operation chamber 2 and the second operation chamber 20 can always serve as a space which has a cleanliness of grade A.

The air cleaning means 36 includes the first air cleaning unit 8 provided upstream of first operation chamber 2, and the second air cleaning unit 38 which is provided downstream of the second operation chamber 20 and upstream of the first air cleaning unit 8. Thus, after air which flowed into the circulation flow passage 35 through the first inlet port 5 of the first operation chamber 2 and the second inlet port 31 of the second operation chamber 20 is cleaned by the second air cleaning unit 38, a portion of the air can be supplied into the second operation chamber 20, and after the remaining portion of the air is further cleaned by the first air cleaning unit 8, the remaining portion of the air can be supplied into the first operation chamber 2. Accordingly, the first operation chamber 2 can always serve as a space which has a cleanliness of grade A.

In this embodiment, the space below the first inlet port communicates with the air passage 7A. Instead, the space below the first inlet port 5 may communicate with the chamber 26 without communicating with the air passage 7A, in this case, air sucked in through the first inlet port 5 together with air sucked in through the second inlet port 31 will circulate through the chamber 26, the second air cleaning unit 38, the chamber 23, the air passage 7A, and the air passage 22 in order.

An air circulation system which includes the second operation chamber 20, the second inlet port 31, the chambers 26 and 23, the fan 28, the second air cleaning unit 38, the air passage 22, and the like according to this embodiment may be provided in a containment apparatus, such as an isolator.

REFERENCE SIGNS LIST

K1 Safety cabinet
1 Workbench
2 First operation chamber
2*a* Bottom face of first operation chamber
3 First operation opening
8 First air cleaning unit
5 First inlet port
20 Second operation chamber
20*a* Bottom face of second operation chamber
30 Second operation opening
31 Second inlet port
35 Circulation flow passage
36 Air cleaning means
38 Second air cleaning unit
40 Working table

The invention claimed is:

1. A safety cabinet comprising:

a workbench;

a first operation chamber which is disposed above the workbench, and into which clean air is supplied;

a first operation opening communicating the first operation chamber with the outside;

a first inlet port which is disposed at a bottom of the first operation chamber, and which sucks in the clean air supplied into the first operation chamber and air flowing in from the outside through the first operation opening;

a second operation chamber which is disposed in the first operation chamber, and into which clean air is supplied;

a second inlet port which is disposed at a bottom of the second operation chamber, and which sucks in air in the second operation chamber and a portion of air in the first operation chamber; and a second operation opening facing the first operation opening, the second operation opening communicating the second operation chamber with the first operation chamber, wherein a bottom face of the second operation chamber is located below a bottom face of the first operation chamber, and the second inlet port is disposed between the two bottom faces.

2. The safety cabinet according to claim 1, wherein a working table is placed on the bottom face of the second operation chamber.

3. The safety cabinet according to claim 2, further comprising a circulation flow passage which circulates air sucked in through the first inlet port and the second inlet port through the first operation chamber and the second operation chamber, and air cleaning means, wherein the circulation flow passage is provided with air cleaning means.

4. The safety cabinet according to claim 3, wherein the air cleaning means comprises a first air cleaning unit disposed upstream of the first operation chamber relative to a direction of the air flowing from the first air cleaning unit to the first operation chamber, and a second air cleaning unit disposed downstream of the second operation chamber and upstream of the first air cleaning unit relative to a direction of the air flowing from the second operation chamber to the first cleaning unit.

5. The safety cabinet according to claim 1, further comprising a circulation flow passage which circulates air sucked in through the first inlet port and the second inlet port through the first operation chamber and the second operation chamber, and air cleaning means, wherein the circulation flow passage is provided with air cleaning means.

6. The safety cabinet according to claim 5, wherein the air cleaning means comprises a first air cleaning unit disposed upstream of the first operation chamber relative to a direction of the air flowing from the first air cleaning unit to the first operation chamber, and a second air cleaning unit disposed downstream of the second operation chamber and upstream of the first air cleaning unit relative to a direction of the air flowing from the second operation chamber to the first cleaning unit.

* * * * *